US005744687A

United States Patent [19]

Ramachandran et al.

[11] Patent Number: 5,744,687

[45] **Date of Patent: *Apr. 28, 1998**

[54] PROCESS FOR RECOVERING ALKENES FROM CRACKED HYDROCARBON STREAMS

[75] Inventors: Ramakrishnan Ramachandran, Allendale; Loc H. Dao, Bound Brook, both of N.J.

[73] Assignee: The BOC Group, Inc., New Providence, N.J.

[ * ] Notice: The term of this patent shall not extend beyond the expiration date of Pat. No. 5,365,011.

[21] Appl. No.: 231,559

[22] Filed: Apr. 22, 1994

Related U.S. Application Data

[63] Continuation-in-part of Ser. No. 159,028, Nov. 29, 1993, abandoned.

[51] Int. Cl.[6] ..... C07C 7/13

[52] U.S. Cl. ..... 585/829; 585/820; 585/826; 208/103; 208/310 Z; 95/90; 95/96; 95/106; 95/902

[58] Field of Search ..... 208/310 Z, 103; 585/820, 826, 829; 95/90, 96, 106, 902

[56] References Cited

U.S. PATENT DOCUMENTS

| | | | |
|---|---|---|---|
| 3,067,271 | 12/1962 | Fleck et al. | 585/829 |
| 3,893,905 | 7/1975 | Fenske et al. | 208/103 |
| 4,547,205 | 10/1985 | Steacy | 95/92 |
| 4,639,308 | 1/1987 | Lee | 208/103 |
| 4,717,398 | 1/1988 | Pearce | 95/902 |
| 4,917,711 | 4/1990 | Xie et al. | 55/68 |
| 5,012,037 | 4/1991 | Doshi et al. | 585/826 |
| 5,365,011 | 11/1994 | Ramachandran et al. | 585/829 |

FOREIGN PATENT DOCUMENTS 221128 5/1980 Germany .

OTHER PUBLICATIONS

Adsorptive Separation of Propylene—Propane Mixtures—Harri Jarvelin and James R. Fair, 1993.

Zeolite Molecular Sieves—Donald W. Breck—Union Carbide Corporation, pp. 635–642, 1974.

Union Carbide Molecular Sieves Hydrocarbon Materials Data Sheets (Propylene Adsorption, Hydrocarbon Adsorption, Propane Adsorption, Ethylene Adsorption, Ethane Adsorption, Vapor Adsorbate Equilibira Data, Capacity for Ethane–Ethlene Mixtures). (No Date).

*Primary Examiner*—Walter D. Griffin

*Attorney, Agent, or Firm*—Coleman R. Reap; Salvatore P. Pace

[57] ABSTRACT

A hydrocarbon stream is cracked to produce a hot gaseous stream which is compressed and cooled to condense almost all of the hydrocarbons contained in the stream. A noncondensed stream remaining after the condensation step, comprised predominantly of hydrogen and $C_1$ to $C_3$ hydrocarbons, is subjected to pressure swing adsorption or temperature swing adsorption at an adsorption temperature of about 0° to about 250° C. in a bed of adsorbent which selectively adsorbs ethylene and propylene, thereby adsorbing substantially all of the ethylene and propylene from the gas stream. The ethylene and/or propylene is recovered upon bed regeneration.

24 Claims, 1 Drawing Sheet

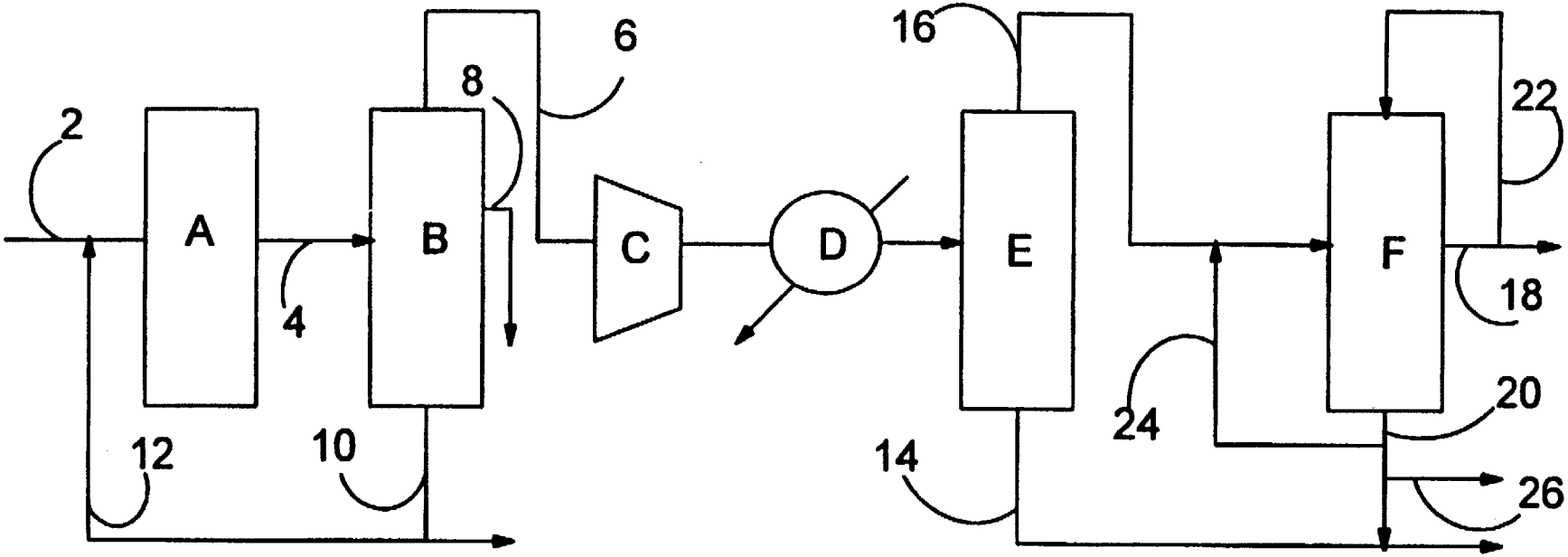
A
B
C
D
E
F
2
4
6
8
10
12
14
16
18
20
22
24
26

PROCESS FOR RECOVERING ALKENES FROM CRACKED HYDROCARBON STREAMS

RELATED CASE

This application is a continuation-in-part of application Ser. No. 159,028, filed Nov. 29, 1993, now abandoned.

FIELD OF THE INVENTION

This invention relates to the cracking of hydrocarbons and more particularly to the recovery of olefins from the off-gas from a catalytic cracking operation.

BACKGROUND OF THE INVENTION

The effluent from a hydrocarbon cracking unit contains a wide spectrum of hydrocarbons. To recover the hydrocarbons the effluent is cooled and subjected to a series of separation steps, such as condensation and distillation to recover the heavy and light liquid components. After removal of these components, the remaining light gas stream can be compressed and cooled, thereby condensing most of the remaining hydrocarbons from the stream. The noncondensable gas remaining after the light gas compression and condensation step, generally referred to as off-gas, is comprised substantially of hydrogen and small amounts of $C_1$ to $C_3$ hydrocarbons, and perhaps some other gaseous components, such as nitrogen and carbon dioxide. The off-gas is usually sent to flare or used as fuel. To minimize the amount of hydrocarbons remaining in the off-gas, the light gas stream is compressed to as high a pressure and cooled to as low a temperature as is practicable. Consequently, the energy expended in cooling and compressing the condensable light gases is considerable.

It is desirable to reduce the overall cost of recovering cracked hydrocarbon products and maximize the amount of valuable $C_2$ and $C_3$ alkenes recovered from the hydrocarbon cracking unit off-gas. This objective could be attained if an efficient and cost effective method of recovering lower alkenes from gas streams were available. The present invention provides an alkene adsorption method which reduces the energy requirements of hydrocarbon cracking processes and provides substantially complete recovery of the lower alkenes contained in cracking unit off-gas.

SUMMARY OF THE INVENTION

According to the invention, a hydrocarbon feed stock is cracked to yield a product comprising a mixture of lower hydrocarbons. Easily condensable hydrocarbon components are first separated from the cracked product and the remaining gaseous effluent is compressed and cooled, thereby producing a condensate containing additional hydrocarbons and leaving an off-gas comprised predominantly of hydrogen and $C_1$ to $C_3$ hydrocarbons, and perhaps other gases, such as nitrogen. The off-gas stream is subjected to a pressure swing adsorption (PSA) process or a temperature swing adsorption (TSA) process at an elevated temperature in a bed of adsorbent which preferentially adsorbs alkenes from a gas stream contain the alkenes and one or more alkanes. The adsorption process is operated under conditions which result in the production of a nonadsorbed gas component containing most of the hydrogen and alkane components (and nitrogen, if present) contained in the off-gas, and an adsorbed component containing most of the alkene components in the stream. The process is desirably operated to retain substantially all of the alkene in the gas stream.

The adsorption step is typically carried out at a temperature in the range of about 0° C. to about 250° C., and is preferably carried out at a temperature above about 50° C. The adsorption step is generally carried out at an absolute pressure in the range of about 0.2 to 100 bar, and is preferably carried out carried out at an absolute pressure of about 1 to 50 bar.

In a preferred embodiment of the invention, the adsorbent is a type A zeolite, and in the most preferred embodiment, it is type 4A zeolite.

When the adsorption process is PSA, the pressure during the regeneration step is reduced, usually to an absolute pressure in the range of about 100 to about 5000 millibar, and preferably to an absolute pressure in the range of about 100 to about 2000 millibar. When the adsorption process is TSA, the bed temperature is usually raised during bed regeneration to a value in the range of about 100° to about 350° C., and is preferably raised to a value in the range of about 150° to 300° C.

In other preferred embodiments of the invention the adsorption bed regeneration step is effected by vacuum means or by purging the bed with one or more of an inert gas, the nonadsorbed gas product from the adsorption system or the adsorbed product gas from the adsorption system, or by combinations of vacuum and purge regeneration; and bed repressurization is at least partly effected using the alkene-enriched desorbed gas from the adsorption system.

BRIEF DESCRIPTION OF THE DRAWING

The drawing illustrates, in a block diagram, a system for cracking hydrocarbons in accordance with a principal embodiment of the present invention.

DETAILED DESCRIPTION OF THE INVENTION

In the principal aspect of the invention a hydrocarbon stream is cracked, thereby producing a gaseous product comprised mainly of hydrogen and a wide spectrum of hydrocarbons. This product is cooled and fractionated, thereby separating out the heavy and intermediate hydrocarbons in the product. The condensed hydrocarbon mixture is generally further processed to recover various hydrocarbon cuts and high purity hydrocarbons from the stream. The gas phase remaining after the condensation step, typically containing hydrogen and $C_4$ and lighter hydrocarbons is compressed, cooled and fractionated or flashed to separate the condensable gases from the stream. The noncondensables, comprised predominantly of hydrogen, methane and a small amount of $C_2$ and $C_3$ hydrocarbons is subjected to a pressure swing adsorption process or a temperature swing adsorption process to produce an adsorbed phase rich in ethylene and propylene and a nonadsorbed phase rich in hydrogen and the alkanes (and nitrogen, if present) present in the gas stream. After being desorbed from the adsorption system the ethylene-propylene mixture is discharged from the system for further purification or combined with the condensable gas stream.

The invention can be better understood from the accompanying drawing. Auxiliary equipment not necessary for an understanding of the invention, including compressors, heat exchangers and valves, has been omitted from the drawing to simplify discussion of the invention.

In the drawing, A is a hydrocarbon cracking plant, B is a fractionator, C is a gas compressor, D is heat exchanger, E is a demethanizer or a flash chamber and F an adsorbent-based gas separation system.

Plant A may be any hydrocarbon cracking system typically used in petroleum refining operations. The particular cracking method employed in the process of the invention forms no part of the invention and any of the commonly used thermal and catalytic cracking processes can be used in the practice of the invention. Cracking unit A is typically equipped on its inlet end with hydrocarbon feed line 2 and its cracked gas outlet is connected to the inlet of fractionator B via line 4. Fractionator B is a conventional fractionating column designed to produce an overhead stream comprised of $C_4$ and lighter hydrocarbons, a side stream comprised of $C_5$ and heavier liquid hydrocarbons and a bottoms stream comprised of heavy residual components. The overhead stream, the $C_5$ and heavier product stream and residual product stream are discharged from column B through lines 6, 8 and 10, respectively. Line 10 is connected to the inlet of unit A through line 12. Line 6 joins the overhead outlet of column B with the inlet of unit E. Compressor C and cooler D are located in line 6. Compressor C and cooler D are any typical gas compressor and heat exchanger usable for compressing and cooling hydrocarbon gases. Unit E is any conventional flash chamber or fractionating column, and it is designed to separate the noncondensable off-gas from the condensable light hydrocarbon components contained in the feed stream to this unit. The condensed light hydrocarbons are discharged from unit E through line 14. Line 16 connects the off-gas outlet of unit E to the inlet of separator F.

Separator F is an adsorption system whose principal function is to separate the alkenes contained in the off-gas from unit E (mainly ethylene or propylene) from the other gases contained in this stream. This unit is typically a pressure swing adsorption or temperature swing adsorption system, generally comprising two or more stationary beds arranged in parallel and adapted to be operated in a cyclic process comprising adsorption and desorption. In such systems the beds are cycled out of phase to assure a pseudo-continuous flow of alkene-enriched gas from the adsorption system.

The beds of separator F are packed with an adsorbent which selectively adsorbs alkenes from a gas mixture containing the alkenes and one or more alkanes. In general, the adsorbent may be alumina, silica, zeolites, carbon molecular sieves, etc. Typical adsorbents include alumina, silica gel, carbon molecular sieves, zeolites, such as type A and type X zeolite, type Y zeolite, etc. The preferred adsorbents are type A zeolites, and the most preferred adsorbent is type 4A zeolite.

Type 4A zeolite, i.e. the sodium form of type A zeolite, has an apparent pore size of about 3.6 to 4 Angstrom units. This adsorbent provides enhanced selectivity and capacity in adsorbing ethylene from ethylene-ethane mixtures and propylene from propylene-propane mixtures at elevated temperatures. This adsorbent is most effective for use in the invention when it is substantially unmodified, i.e. when it has only sodium ions as its exchangeable cations. However, certain properties of the adsorbent, such as thermal and light stability, may be improved by partly exchanging some of the sodium ions with other cations. Accordingly, it is within the scope of the preferred embodiment of the invention to use a type 4A zeolite in which some of the sodium ions attached to the adsorbent are replaced with other metal ions, provided that the percentage of ions exchanged is not so great that the adsorbent loses its type 4A character. Among the properties that define type 4A character are the ability of the adsorbent to selectively adsorb ethylene from ethylene-ethane mixtures and propylene from propylene-propane gas mixtures at elevated temperatures, and to accomplish this result without causing significant oligomerization or polymerization of the alkenes present in the mixtures. In general, it has been determined that up to about 25 percent (on an equivalent basis) of the sodium ions in 4A zeolite can be replaced by ion exchange with other cations without divesting the adsorbent of its type 4A character. Cations that may be ion exchanged with the 4A zeolite used in the alkene-alkane separation include, among others, potassium, calcium, magnesium, strontium, zinc, cobalt, silver, copper, manganese, cadmium, aluminum, cerium, etc. When exchanging other cations for sodium ions it is preferred that less than about 10 percent of the sodium ions (on an equivalent basis) be replaced with such other cations. The replacement of sodium ions may modify the properties of the adsorbent. For example, substituting some of the sodium ions with other cations may improve the stability of the adsorbent.

Another class of preferred adsorbents are those which contain certain oxidizable metal cations, such as copper-containing adsorbents, which possess enhanced adsorptive capacity and selectivity with respect to the preferential adsorption of alkenes from gaseous alkene-alkane mixtures. Suitable adsorbent substrates for manufacturing copper-modified adsorbents include silica gel, and zeolite molecular sieves, such as zeolite type 4A, zeolite type 5A, zeolite type X and zeolite type Y. The manufacture and use of copper-modified adsorbents and examples of suitable copper-containing adsorbents are set forth in U.S. Pat. No. 4,917,711, the disclosure of which is incorporated herein by reference.

Separator F is provided with waste gas discharge line 18, purge gas line 20 and alkene discharge line 22, which, in the embodiment illustrated in the drawing, is connected to condensed light hydrocarbon discharge line 14. Purged gas recycle line 24 connects line 22 to the inlet to separator F.

According to the process of the invention practiced in the system illustrated in the drawing, a hydrocarbon cracker feed stream, such as gas oil, is introduced into cracking unit A. The hydrocarbon feed is typically cracked into a hot gaseous product comprised of mixed hydrocarbons, e.g. hydrocarbons having up to about 12 carbon atoms, and a heavy hydrocarbon residual product. The hot gaseous product leaves unit A and is next separated in fractionator B into a heavy residual stream, which is removed through line 10 and discharged from the system or recycled to unit A through line 12; a intermediate hydrocarbon stream comprised mostly of liquid hydrocarbons having 5 or more carbon atoms, which is removed through line 8; and a light hydrocarbon gas stream comprised substantially of hydrogen, hydrocarbons having up to 4 carbon atoms, and perhaps nitrogen, which leaves column B via line 6. The light hydrocarbon gas stream passing through line 6 is compressed in unit C to the desired pressure, cooled in heat exchanger D to the temperature at which most of the $C_2$ to $C_4$ hydrocarbons in the stream are condensed and introduced into unit E. A product stream comprised of the readily condensable components of the feed to unit E is removed from this unit through line 14 and sent to downstream processing units for further hydrocarbon separation. A gas stream comprised predominantly of hydrogen and $C_1$ to $C_3$ hydrocarbons is discharged from unit E through line 16 and is introduced into separator F.

As the off-gas passes through the adsorption beds of separator F the alkene components of the stream are adsorbed onto the adsorbent while the hydrogen and alkanes (and any nitrogen present) in the gas stream pass through the adsorbent and exit separator F through line 18 as nonadsorbed gas. Separator F is preferably operated in a manner which results in the adsorption of substantially all of the alkene and rejection of most of the hydrogen and alkane present in the feed to this unit.

The temperature at which the adsorption step is carried out depends upon a number of factors, such as the particular adsorbent being used, e.g. unmodified 4A zeolite, a particular metal-exchanged 4A zeolite or another adsorbent which selectively adsorbs alkenes from alkene-alkane mixtures, and the pressure at which the adsorption is carried out. In general, the adsorption step is carried out at a minimum temperature of about 0° C. and is preferably carried out at a minimum temperature of about 50° C. and is most preferably carried out at a temperature of at least about 70° C. The upper temperature limit at which the adsorption step in unit A is carried out is determined mostly by economics. In general the adsorption step can be carried out at a temperature below the temperature at which the alkene undergoes chemical reaction, such as polymerization. The upper adsorption temperature limit is about 250° C. When unmodified 4A zeolite is used as the adsorbent the reaction is generally carried out at or below 200° C., and is preferably carried out at a temperature at or below 170° C. Oxidizable metal-containing adsorbents, such as copper modified adsorbents, are particularly effective at temperatures above about 100° C., for example at temperatures between about 100° C. and 250° C. They are preferably used at temperatures in the range of about 110° to 200° C., and most preferably at temperatures in the range of about 125° to about 175° C.

The pressures at which the adsorption step is carried out generally ranges from about 0.2 to about 100 bar, and preferably from about 1 to 50 bar for pressure swing adsorption cycles, and is usually about atmospheric or above for temperature swing adsorption cycles.

When the adsorption process is PSA the regeneration step is generally carried out a temperature in the neighborhood of the temperature at which the adsorption step is carried out and at an absolute pressure lower than the adsorption pressure. The pressure during the regeneration step of PSA cycles is usually in the range of about 20 to about 5000 millibar, and preferably in the range of about 100 to about 2000 millibar. When the adsorption process is TSA, bed regeneration is carried out at a temperature higher than the adsorption temperature, usually in the range of about 100° to about 350° C., and preferably in the range of about 150° to 300° C. In the TSA embodiment, the pressure is generally the same during the adsorption and regeneration steps, and it is often preferred to conduct both steps at about atmospheric pressure or above. When a combination of PSA and TSA is used the temperature and pressure during the bed regeneration step are higher and lower, respectively, than they are during the adsorption step.

When the adsorbed alkene front traveling through the vessel(s) of separator F in which the adsorption step is being carried out reaches the desired point in the vessel(s), the adsorption process in these vessel(s) is terminated and these vessels enter the regeneration mode. During regeneration, the alkene-loaded vessels are depressurized, if the adsorption cycle is pressure swing adsorption, or heated, if a temperature swing adsorption cycle is employed. As the regeneration proceeds, alkene-enriched gas is discharged from separator F through line 20. This stream can be combined with the light hydrocarbon stream in line 14, as illustrated in the drawing, or discharged from the system for further processing.

The method of regeneration of the adsorption beds depends upon the type of adsorption process employed. In the case of pressure swing adsorption, the regeneration phase generally includes a countercurrent depressurization step during which the beds are vented countercurrently until they attain the desired lower pressure. If desired the pressure in the beds may be reduced to subatmospheric pressure by means of a vacuum inducing device, such as a vacuum pump (not shown).

In some cases, in addition to the countercurrent depressurization step(s), it may be desirable to purge the bed with an inert gas or one of the gas streams exiting separator F. In this event the purge step is usually initiated towards the end of the countercurrent depressurization step, or subsequent thereto. During the purge step, a nonadsorbable purge gas can be introduced into separator F via line 20 and passed countercurrently through the adsorbent beds, thereby forcing desorbed alkene out of out of separator F through line 22. The purge gas may be nonadsorbed product gas exiting separator F through line 18, or a nonadsorbable gas obtained from a different source, such as an inert permanent gas like nitrogen.

In a preferred method of operation of the system of the drawing, the alkene desorbed from separator F during the countercurrent depressurization step(s) is discharged into line 14, and all or a portion of the purge gas and alkene desorbed from the bed during the purge step is recycled to separator F through line 24 for reprocessing. The advantage of this embodiment is that it permits the amount of purge gas that is transferred to line 14 to be minimized.

The adsorption cycle may contain steps other than the fundamental steps of adsorption and regeneration. For example, it may be advantageous to depressurize the adsorption bed in multiple steps, with the first depressurization product being used to partially pressurize another bed in the adsorption system. This will further reduce the amount of gaseous impurities transferred to line 14. It may also be desirable to include a cocurrent purge step between the adsorption phase and the regeneration phase. The cocurrent purge is effected by terminating the flow of feed gas into separator F and passing high purity alkene cocurrently into the adsorption bed at adsorption pressure. This has the effect of forcing nonadsorbed gas in the void spaces in separator F toward the nonadsorbed gas outlet, thereby ensuring that the alkene produced during the countercurrent depressurization will be of high purity. The high purity alkene used for the cocurrent purge can be obtained from an intermediate storage facility in line 22 (not shown), when separator F comprises a single adsorber; or from another adsorber that is in the adsorption phase, when separator F comprises multiple adsorbers arranged in parallel and operated out of phase.

It will be appreciated that it is within the scope of the present invention to utilize conventional equipment to monitor and automatically regulate the flow of gases within the system so that it can be fully automated to run continuously in an efficient manner.

An important advantage of the invention is that it permits removal of valuable alkenes from a hydrocarbon cracking unit off-gas stream without also removing substantial amounts of the low value alkanes contained in the off-gas. It will be appreciated that a system that achieves enhanced selectivity, and hence increased overall recovery of alkenes from a cracking operation is highly beneficial.

The invention is further illustrated by the following hypothetical example in which, unless otherwise indicated, parts, percentages and ratios are on a volume basis. The example illustrates the process of the invention as it applies to the catalytic cracking of a gas oil.

EXAMPLE 1

A gaseous gas oil stream is processed in a fluid catalytic cracker containing a catalyst based on type Y zeolite and other active components at a temperature of about 400° C., thereby producing a gaseous product stream. The gaseous product is fractionated into a viscous bottoms product, which is combined with the gas oil feed to the catalytic cracking unit; a condensed mixed hydrocarbons side stream containing mostly $C_5$ and higher hydrocarbons, which is removed as a liquid product; and a gaseous overhead stream comprised mostly of $C_4$ and lighter hydrocarbons. The overhead stream is compressed to a pressure of 33 bar, cooled to a temperature of 150° C. and introduced into a light hydrocarbon fractional distillation unit, wherein the overhead stream is split into a bottoms stream comprising most of the hydrocarbons and an overhead noncondensable gas stream having the concentration listed in the Table as stream 1.

The noncondensable gas stream is subjected to a pressure swing adsorption process having a two minute cycle in an adsorption system comprised of a pair of adsorption vessels packed with type 4A zeolite. The adsorption vessels are arranged in parallel and operated out of phase. During the adsorption step the beds are maintained at a temperature of 100° C. and an absolute pressure of 8 bar, and during bed regeneration the beds are depressurized to an absolute pressure of 1.2 bar. Desorbed and nonadsorbed gas streams having the compositions listed in the Table as streams 2 and 3, respectively, are obtained.

| COMPONENTS | STREAM 1 lbmoles/hr | STREAM 2 lbmoles/hr | STREAM 3 lbmoles/hr |
|---|---|---|---|
| hydrogen | 178.8 | 17.9 | 160.9 |
| methane | 955.8 | 372.7 | 583.0 |
| ethane | 402.7 | 169.2 | 233.6 |
| ethylene | 209.6 | 167.7 | 41.9 |
| propylene | 248.7 | 156.7 | 92.0 |
| propane | 32.9 | 11.8 | 21.0 |
| isobutane | 2.0 | 0.0 | 2.1 |
| 1-butene | 2.0 | 0.0 | 2.0 |
| cis 2-butene | 0.0 | 0.0 | 0.0 |
| normal butane | 2.0 | 0.0 | 2.0 |
| isopentene | 2.0 | 0.0 | 2.0 |
| normal pentane | 2.0 | 0.0 | 2.0 |
| hexane | 3.8 | 0.0 | 3.8 |
| TOTAL | 2,042.3 | 896.0 | 1,146.3 |

Although the invention has been described with particular reference to a specific experiment, this experiment is merely exemplary of the invention and variations are contemplated. For example, the process of the invention may be practiced in equipment arrangements other than those illustrated in the drawings. The scope of the invention is limited only by the breadth of the appended claims.

We claim:

1. A process for the recovery of alkene selected from ethylene, propylene and mixtures of these from a cracked hydrocarbon stream comprising the steps:

(a) separating a gaseous stream from the cracked hydrocarbon stream;

(b) cooling the gaseous stream, thereby producing a condensed hydrocarbon stream and a gas stream comprised predominantly of hydrogen and methane and containing small amounts of alkene and alkane selected from ethane, propane and mixtures of these;

(c) subjecting said gas stream to adsorption at a temperature above about 50° C. in an adsorption vessel containing an adsorbent which selectively adsorbs alkenes, selected from the group consisting of 4A-zeolite, 5A zeolite, 13X-zeolite and mixtures of these, thereby producing a nonadsorbed hydrogen- and alkane-enriched component and an adsorbed alkene-enriched component; and (d) desorbing said alkene-enriched component from said adsorbent by reducing the pressure in said adsorption vessel, by raising the temperature in said adsorption vessel or by reducing the pressure and raising the temperature in said adsorption vessel.

2. The process of claim 1, additionally comprising compressing said gaseous stream.

3. The process of claim 1, wherein the adsorption step is conducted at a temperature in the range of about 50° to about 250° C.

4. The process of claim 3, wherein the adsorbent is zeolite 4A, zeolite 5A or mixtures of these.

5. The process of claim 4, wherein the adsorbent contains an oxidizable metal ion.

6. The process of claim 5, wherein said oxidizable metal ion is copper ion.

7. The process of claim 6, wherein the adsorption step is carried out at a temperature between about 100° and about 200° C.

8. The process of claim 4, wherein said adsorbent is 4A zeolite.

9. The process of claim 8, wherein said adsorbent contains exchangeable cations other than sodium ions, but at a level insufficient to divest the adsorbent of its type 4A character.

10. The process of claim 8, wherein the adsorption step is carried out at a temperature in the range of about 50° to about 200° C. and an absolute pressure in the range of about 0.2 to 100 bar.

11. The process of claim 8, wherein the adsorption step is carried out at a temperature in the range of about 70 to about 170° C. and an absolute pressure of about 1 to 50 bar.

12. The process of claim 1 or claim 8, wherein steps (c) and (d) are steps of a pressure swing adsorption process in which the adsorbent is regenerated at an absolute pressure in the range of about 20 to about 5000 millibar.

13. The process of claim 1 or claim 8, wherein steps (c) and (d) are steps of a temperature swing adsorption process in which the adsorbent is regenerated at a temperature in the range of about 100° to about 350° C.

14. The process of claim 1, wherein said cracked hydrocarbon stream is produced by catalytic cracking.

15. The process of claim 1, wherein said gas stream is separated from said condensed hydrocarbon stream by flashing, distillation or a combination of these.

16. The process of claim 1, wherein the desorbed alkene-enriched component is combined with said condensed hydrocarbon stream.

17. The process of claim 8, wherein said 4A zeolite contains copper ion and step (d) is carried out at a temperature in the range of about 125° to about 250° C.

18. The process of claim 8, wherein the 4A zeolite is at least partly regenerated by countercurrent depressurization.

19. The process of claim 18, wherein the type 4A zeolite is further regenerated by depressurization to subatmospheric pressure by means of vacuum.

20. The process of claim 18, wherein the type 4A zeolite is further regenerated by purging it with an inert gas, the nonadsorbed hydrogen- and alkane-enriched component, the desorbed alkene-enriched component or combinations of these.

21. The process of claim 1, wherein said alkene is ethylene.

22. The process of claim 21, wherein said alkane is ethane.

23. The process of claim 1, wherein said alkene is propylene.

24. The process of claim 23, wherein said alkane is propane.

* * * * *